United States Patent [19]

Terraillon et al.

[11] Patent Number: 4,532,411

[45] Date of Patent: Jul. 30, 1985

[54] ELECTRIC FABRIC STEAMING APPLIANCE HAVING A DETACHABLE METALLIC SOLE-PLATE

[76] Inventors: Marc Terraillon, 16, rue des Granges, 1204 Geneva, Switzerland; Daniel Mazzucco, 3, rue Ecole Maternelle, Annemasse, France

[21] Appl. No.: 474,291

[22] Filed: Mar. 11, 1983

[30] Foreign Application Priority Data

Mar. 19, 1982 [CH] Switzerland ..... 1772/82

[51] Int. Cl.[3] ..... H05B 1/02; D06F 75/16; D06F 75/32

[52] U.S. Cl. ..... 219/245; 38/69; 38/77.8; 38/77.82; 38/77.9; 38/81; 38/93; 38/97; 219/228; 219/271; 219/275

[58] Field of Search ..... 219/245, 228, 271, 275; 38/69, 81, 77.1–77.9, 93, 97

[56] References Cited

U.S. PATENT DOCUMENTS

| | | | |
|---|---|---|---|
| 1,736,148 | 11/1929 | Brewer | 38/77.7 |
| 2,387,757 | 10/1945 | Hoecker | 38/77.5 |
| 2,499,835 | 3/1950 | Rakos | 38/77.7 |
| 2,637,125 | 5/1953 | Roberts | 38/97 X |
| 2,861,365 | 11/1958 | Block | 38/77.82 |
| 3,142,916 | 8/1964 | Jacobson | 38/93 |
| 3,404,471 | 10/1968 | Wilsker et al. | 38/97 |
| 3,755,649 | 8/1973 | Osrow | 219/245 |
| 4,196,340 | 4/1980 | Evans et al. | 219/284 X |
| 4,206,340 | 6/1980 | Osrow et al. | 219/245 X |
| 4,366,367 | 12/1982 | Mazzucco | 219/245 X |

*Primary Examiner*—A. Bartis

*Attorney, Agent, or Firm*—Pennie & Edmonds

[57] ABSTRACT

An electric fabric steaming appliance includes a non-metallic hollow-body having a first compartment provided with an electric heater for heating water received and contained in the first compartment to generate steam supplied to a second compartment on the body and having a non-metallic wall with orifices through which the steam can issue for steaming a fabric or textile material to remove creases with or without direct contact with the non-metallic wall. A metallic sole-plate having an exposed ironing surface is removable attached to the body in spaced relationship to the non-metallic wall to define therewith a sealed third compartment receiving steam from the orifices of the non-metallic wall to heat the sole-plate. The sole-plate has steam outlets through which the steam exists during an ironing operation wherein the sole-plate contacts the fabric being ironed. The sole-plate may be provided with a peripheral electric heating element surrounding the third compartment and controlled by an adjustable thermostat so that the appliance can be used both as an adjustable temperature steam iron with the sole-plate attached ro as a fabric steamer without the sole-plate.

5 Claims, 4 Drawing Figures

ELECTRIC FABRIC STEAMING APPLIANCE HAVING A DETACHABLE METALLIC SOLE-PLATE

BACKGROUND OF THE INVENTION

Appliances for removing creases from textile materials by spraying steam produced in the appliance onto the material itself are well known. Swiss Pat. No. 626,129 and U.S. Pat. No. 4,366,367 illustrate appliances of this type.

SUMMARY OF THE INVENTION

In a first part (10) formed by a hollow body made of plastic, a first compartment (13) is provided in which water may be heated by an electric element (21) to produce steam.

The steam is able to reach a second compartment (14) in the hollow body, from which it can escape through the orifices of a grill or perforated plate (22).

In a first embodiment (FIG. 1), a metallic sole-plate (11) is permanently attached to the first part (10). In another embodiment (FIG. 2), a metallic sole-plate (11*a*) is detachably affixed to the first part (10) forming a compartment (31) therebetween which receives steam from the holes in plate (22). The steam exits from the compartment (31) through holes (32). In the embodiment of FIGS. 3 and 4, a metallic sole-plate (11*b*), provided with holes (32*a*) through which the steam can escape, is attached removably or permanently to the first part (10), and contains an electric heating element (33). The appliance can function in either or both of two ways: either as a crease-remover or as an iron.

BRIEF DESCRIPTION OF THE DRAWINGS

The attached diagrams depict, by way of example, three embodiments of the iron in accordance with the invention.

DESCRIPTION OF THE PREFERRED EMBODIMENTS

Figure 1:
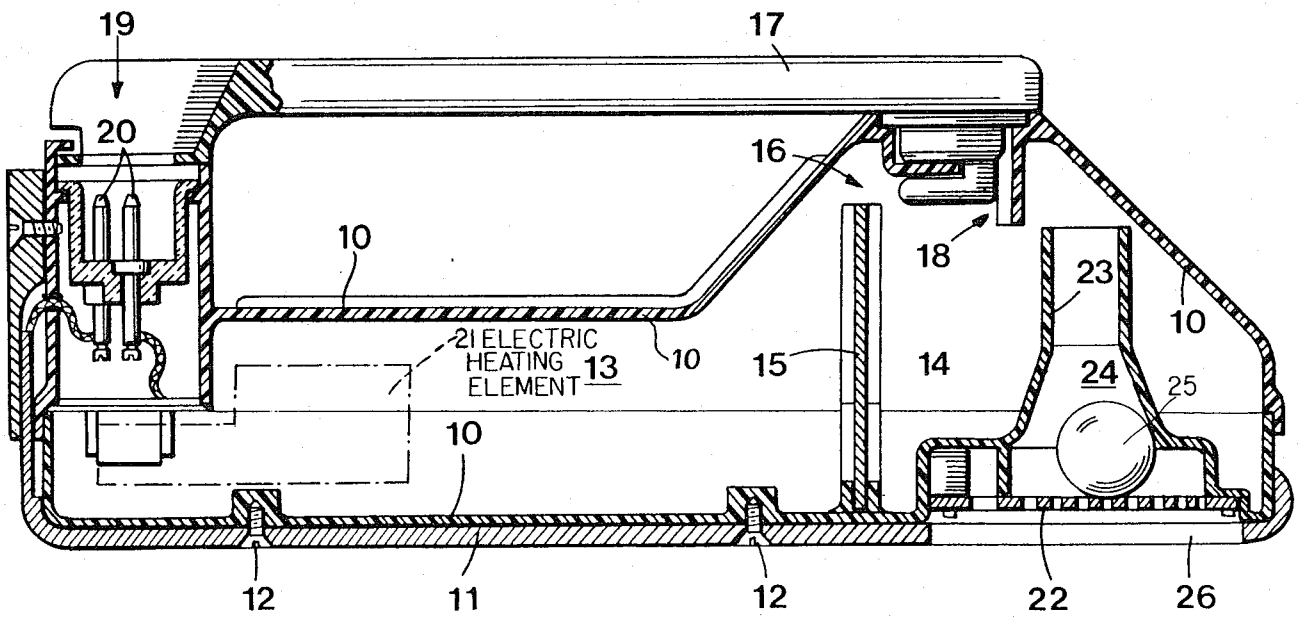
FIG. 1 is a longitudinal view, with certain parts broken away and others in section, of the first embodiment.

The iron illustrated in FIG. 1 consists of two parts, namely a part 10 similar to the crease-remover described in the above-mentioned patent, which will be described in detail below, and a part 11 consisting of a metallic sole-plate permanently attached to the part 10 by means of the screw 12.

The part 10 consists of a hollow moulded plastic shape, containing a first compartment 13 separated by a wall 15 from a second compartment 14 with which it communicates through a space above the wall at 16.

A removable handle 17 is mounted and rotates in an opening 18 in the top of the part 10. Water is introduced into the compartment 13 through this opening. The handle 17 serves to manipulate the appliance when the latter is in the position of use represented in FIG. 1. In this position, a female electric plug designed to mate with the pins 20 can be inserted into 19, to supply power to an electric element 21, which serves to heat the water in the compartment 13. The part 19 of the handle constitutes a safety measure, since the handle 17 can not be rotated and then removed unless the electric plug has been disconnected from the pins 20.

A grill or perforated plate 22 situated in the lower part of The second compartment 14 is surrounded by a piece 23 shaped like an open chimney at the top and like a truncated cone 24 at mid-height. A ball 25 moves freely inside this chimney. When the appliance is in the position shown, the ball 25 rests on the grill or plate 22 leaving the chimney 23, 24 free. If the appliance is inverted, the ball 25 drops into the conical part 24 and blocks it.

This constitutes a safety measure, in that when the appliance is inverted the user is unable to introduce water through the grill into the compartment 14, which would be dangerous, particularly where the electric heating element consisted of metal plates and where heating was effected by the passage of current through the water between the immersed plates.

The metal sole-plate 11 has an opening 26 coinciding with the grill or perforated plate 22.

The appliance illustrated functions as follows:

The element 21 heats the water in the compartment 13 producing steam which passes through 16 and enters the compartment 14, from which it escapes through the chimney 23 and the holes in the plate 22. The steam issuing from these holes may serve to remove creases from a textile material when the appliance is moved in front of this material arranged vertically. If, however, the appliance is used to iron a textile material, the sole-plate 11 functions as in a conventional iron and the appliance operates as a steam iron with steam issuing through the holes 22.

The appliance therefore has a two-fold use.

It should be noted that the presence of the metal sole-plate allows a temperature of approximately 85° C. to be attained, whereas without this sole-plate the lower surface of 10 would hardly reach 70° C.

Figure 2:
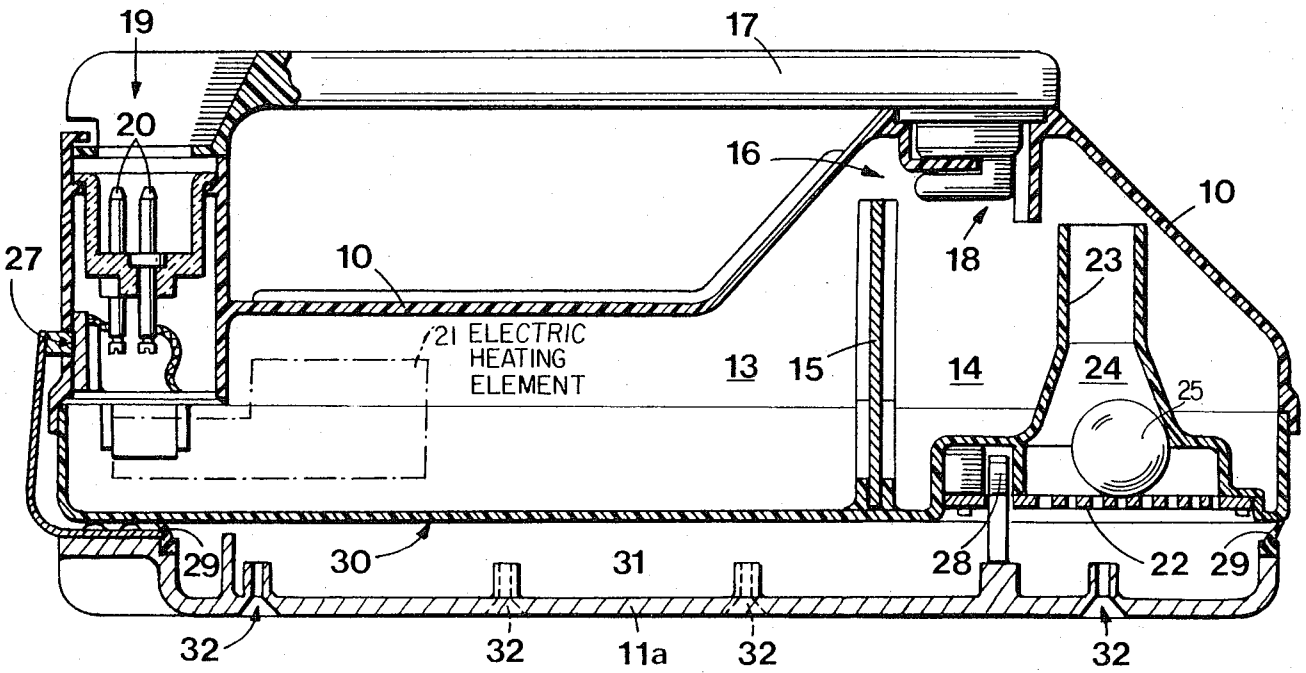
FIG. 2 is an analogous section of the second embodiment.

The reference numbers on the embodiment in FIG. 2 designate features identical to those on FIG. 1, the difference being that in FIG. 2, a detachable metal sole-plate 11*a* which hooks on to a flange on the part 10 at 27 and has a post which fits into a corresponding recess in body (10) at 28 is provided. A washer 29 seals the joint between 11*a* and 10. The shape of the sole-plate 11 is such as to form between it and the lower surface 30 of the part 10, a compartment 31 into which passes the steam issuing through the holes in the plate 22. Furthermore, this sole-plate 11*a* presents holes 32 through which the steam in 31 can escape. The appliance then functions as a conventional steam iron.

When the sole-plate 11*a* is detached from the part 10, the apparatus functions as a crease-remover.

Figures 3, 4:
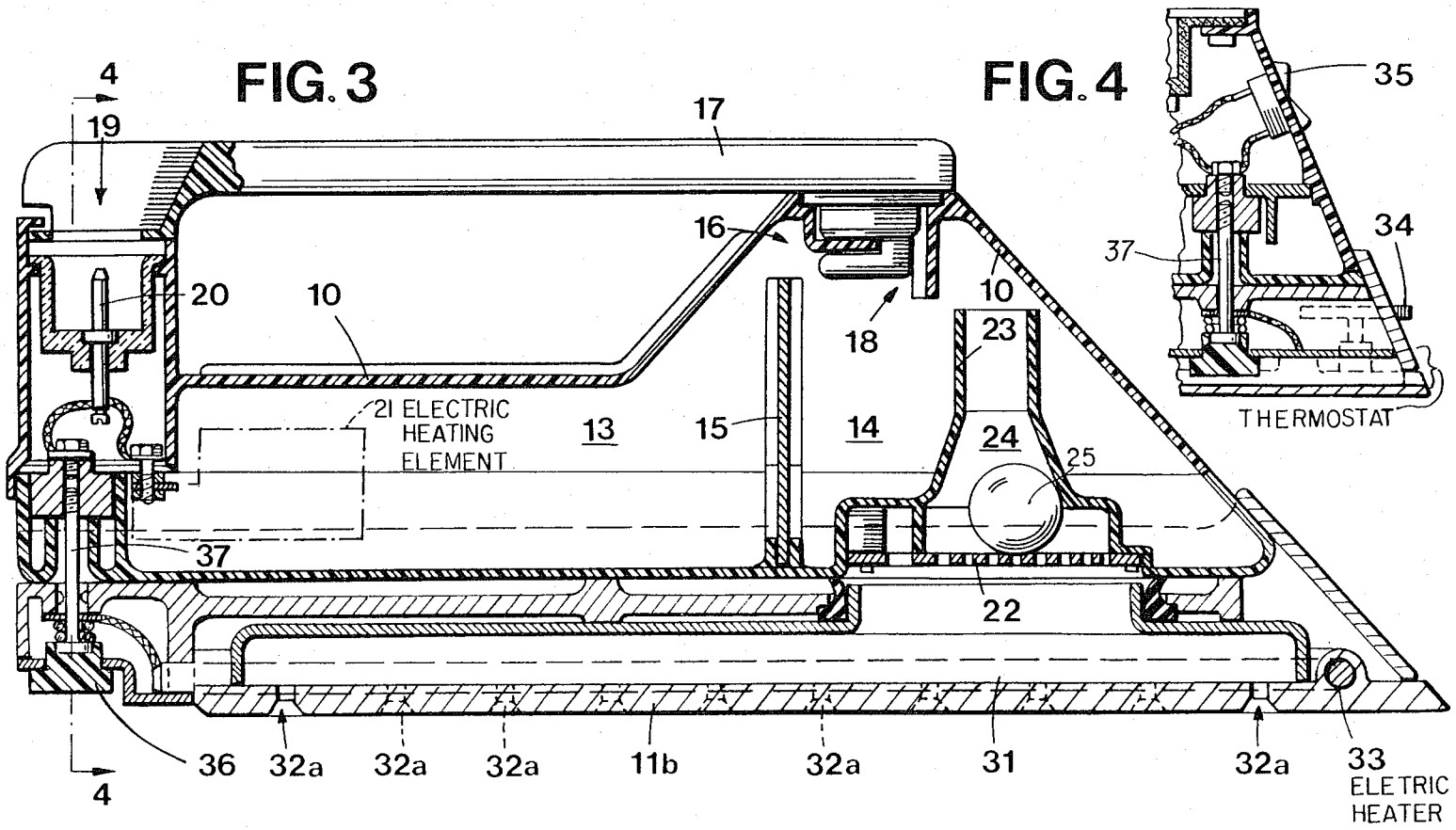
FIG. 3 is an analogous section of the third embodiment.
FIG. 4 is a partial section according to 4—4 of FIG. 3.

The same reference numbers are used again on FIGS. 3 and 4 to designate features identical to those in the example in FIG. 1.

This third example differs from the first in that it consists of a metallic iron sole-plate attached temporarily or permanently to the part 10 and provided with an electric heating body 33 incorporated therein in a known manner. This sole-plate is perforated by holes 32*a*, similar to the holes 32 in FIG. 2 and serving the same purpose.

34 is the control knob of the adjustable thermostat of the sole-plate 11*b*. 35 is the switch controlling 21 and 33.

The screw 37 is provided with a knob 36 which can be turned to loosen the screw so that the sole-plate 11*b* can be detached from the part 10.

It should be noted that in this third example, the sole-plate temperature is independent of the temperature of the water, which is heated by the element 21. This presents the advantage of a constant flow of steam through the holes 32*a*, while the temperature of the sole-plate 11*b* can be adjusted according to the nature of the textile material to be ironed.

The appliance may be used as a crease-remover in the same manner as indicated for FIG. 2.

What we claim is:

1. An electric appliance for steaming fabric including (a) a non-metallic hollow body having (1) a first compartment for receiving and containing water, (2) means for electrically heating the water to produce steam, (3) means on said body for electrically connecting said electric water-heating means to a source of electric power, and (4) a second compartment communicating with the first compartment for receiving and containing the steam, said second compartment having a non-metallic wall with orifices formed therein through which the steam can issue from said second compartment for steaming said fabric without the non-metallic wall contacting said fabric;

(b) a metallic sole-plate having an exposed ironing surface;

(c) means for removably attaching the sole-plate to the non-metallic hollow body for ironing said fabric, said sole-plate being in spaced relationship with said wall of the second compartment so as to define therewith a third compartment receiving steam issuing from said orifices in said wall so as to heat said sole-plate;

(d) steam outlets in said sole-plate and communicating with said third compartment, through which the steam issues for steaming said fabric when said sole-plate is attached to said body; and (e) sealing means extending between said sole-plate and said wall of said second compartment for sealing the periphery of the space defining said third compartment.

2. An electric appliance for steaming fabric including (a) non-metallic hollow body having (1) a first compartment for receiving and containing water, (2) means for electrically heating the water to produce steam, (3) means on said body for connecting said electric water-heating means to a source of electric power, and (4) a second compartment communicating with the first compartment for receiving and containing the steam, said second compartment having a non-metallic wall with orifices formed therein through which the steam can issue from said second compartment for steaming said fabric without said non-metallic wall contacting said fabric;

(b) a metallic sole-plate;

(c) means for removably attaching the sole-plate to the non-metallic hollow body for ironing said fabric, said sole-plate being in spaced relationship with said wall of the second compartment so as to define therewith a third compartment receiving steam issuing from said orifices in said wall so as to heat said sole-plate;

(d) steam outlets in said sole-plate and communicating with said third compartment, through which the steam issues for steaming said fabric when said sole-plate is attached to said body, and (e) a peripheral raised edge on said metallic sole-plate with a sealing washer mounted thereon, the washer projecting toward and contacting the hollow body, and said steam-containing third compartment being sealed substantially solely by said washer.

3. An appliance as in claim 2, further comprising a peripheral electric heating element in said sole-plate substantially surrounding said third compartment, having an adjustable thermostat, whereby the appliance can be used both as an adjustable temperature steam iron with said sole-plate attached and as a fabric steamer without said sole-plate attached, and means for automatically electrically connecting said heating element to the means for electrically connecting the water-heating means to a power source upon attachment of said sole-plate.

4. An electric appliance for steaming fabric comprising (a) a non-metallic hollow body having (1) a first compartment for receiving and containing water, (2) means for electrically heating the water to produce steam, (3) means on said body for connecting said electric water-heating means to a source of electric power, and (4) a second compartment communicating with the first compartment for receiving and containing the steam, said compartment having a non-metallic wall with orifices formed therein through which the steam can issue from said second compartment for steaming said fabric without said non-metallic wall contacting said fabric;

(b) a metallic sole-plate;

(c) means for removably attaching the sole-plate to the non-metallic hollow body for ironing said fabric, said sole-plate being in spaced relationship with said wall of the second compartment so as to define therewith a third compartment receiving steam issuing from said orifices in said wall so as to heat said sole-plate;

(d) steam outlets in said sole-plate and communicating with said third compartment, through which the steam issues for steaming said fabric when said sole-plate is attached to said body;

(e) a peripheral electric heating element in said sole-plate substantially surrounding said third compartment, having an adjustable thermostat, whereby the appliance can be used both as an adjustable temperature steam iron with said sole-plate attached and as a fabric steamer without said sole-plate attached; and (f) means for automatically electrically connecting said heating element to the means for electrically connecting the water-heating means to a power source upon attachment of said sole-plate.

5. An electric appliance for steaming fabric including (a) a non-metallic hollow body having (1) a first compartment for receiving and containing water, (2) means for electrically heating the water to produce steam, (3) means on said body for connecting said electric water-heating means to a source of electric power, and (4) a second compartment communicating with the first compartment for receiving and containing the steam, said second compartment having a non-metallic wall with orifices formed therein through which the steam can issue from said second compartment for steaming said fabric without said non-metallic wall contacting said fabric;

(b) a metallic sole-plate;

(c) means for removably attaching the sole-plate to the non-metallic hollow body for ironing said fabric, said sole-plate being in spaced relationship with said wall of the second compartment so as to define therewith a third compartment receiving steam issuing from said orifices in said wall so as to heat said sole-plate;

(d) steam outlets in said sole-plate and communicating with said third compartment, through which the steam issues for steaming said fabric when said sole-plate is attached to said body, and (e) a hook extending inwardly from the edge of said sole-plate at one end and a post inward of its edge near the other end, said hook projecting toward said hollow body for forming a hinging connection with a corresponding flange thereon, and said post projecting toward said hollow body for fitting into a corresponding recess therein.

* * * * *